US005491474A

United States Patent [19]

Suni et al.

[11] Patent Number: 5,491,474

[45] Date of Patent: Feb. 13, 1996

[54] TELEMETRIC TRANSMITTER UNIT

[75] Inventors: Jouko Suni, Kausala; Tapio Tammi, Oulu, both of Finland

[73] Assignee: Polar Electro Oy, Finland

[21] Appl. No.: 341,999

[22] Filed: Nov. 16, 1994

Related U.S. Application Data

[63] Continuation of Ser. No. 885,607, May 19, 1992, abandoned.

[30] Foreign Application Priority Data

May 22, 1991 [FI] Finland ..... 912487

[51] Int. Cl.[6] ..... G08C 17/04

[52] U.S. Cl. ..... 340/870.31; 128/640; 128/644; 128/903

[58] Field of Search ..... 340/573, 870.30, 340/870.31; 128/903, 904, 639, 640, 644

[56] References Cited

U.S. PATENT DOCUMENTS

| | | | |
|---|---|---|---|
| 3,717,857 | 2/1973 | Evans | 128/903 |
| 3,851,320 | 11/1974 | Dahl | 128/903 |
| 3,943,918 | 3/1976 | Lewis | 128/903 |
| 3,949,388 | 4/1976 | Fuller | 128/903 |
| 4,121,573 | 10/1978 | Crovella et al. | 128/903 |
| 4,471,354 | 9/1984 | Smith | 128/903 |
| 4,494,553 | 1/1985 | Sciavva et al. | 128/903 |
| 4,516,581 | 5/1985 | Sessions | 128/639 |
| 4,606,352 | 8/1986 | Geddes et al. | 128/702 |
| 4,625,733 | 12/1986 | Säynäjäkangas | 128/903 |
| 4,638,807 | 1/1987 | Ryder | 128/644 |
| 4,889,131 | 12/1989 | Salem et al. | 128/903 |
| 4,922,910 | 5/1990 | Kanai et al. | 128/642 |
| 5,113,869 | 5/1992 | Napplolz et al. | 128/903 |

FOREIGN PATENT DOCUMENTS

WO91/01681 2/1991 WIPO .

*Primary Examiner*—Brent A. Swarthout
*Assistant Examiner*—Daniel J. Wu
*Attorney, Agent, or Firm*—Finnegan, Henderson, Farabow, Garrett & Dunner

[57] ABSTRACT

The invention relates to a telemetric transmitter unit, by means of which signals detected by one electrode or several electrodes connected to the transmitter are wirelessly transmittable to a separate receiver by using a magnetic proximity field. The transmitter electronics (6) is coupled in a fixed manner to each electrode (4) by means of a conductive plastic layer (5). The transmitter electronics (6), the electrodes (4) and the conductive plastic layer (5) are cast and/or jointed together with plastic (1, 2, 3) to form an integrated transmitter unit.

9 Claims, 1 Drawing Sheet

TELEMETRIC TRANSMITTER UNIT

This application is a continuation of application Ser. No. 07/885,607, filed May 19, 1992, now abandoned.

BACKGROUND OF THE INVENTION

The present invention relates to a telemetric transmitter unit, by means of which signals detected by one electrode or several electrodes connected to a transmitter are wirelessly transmittable to a separate receiver by using a magnetic proximity field.

Telemetric data transmission and the techniques required for that are well known, cf. e.g. the telemetric measuring device described in Finnish Patent 68743 and meant for the measurement of pulse and EKG signals. Such a telemetric transmitter mainly consists of transmitter electronics encapsuled in a casing and fastened by means of e.g. two buttons to a belt holding the transmitter in place and of electrodes electrically connected to the transmitter electronics and (2 of them) located on the surface of the belt towards the user's skin on both sides of the transmitter electronics.

In prior art transmitter structures, electrical connections thus comprise four parts, viz. electronics, buttons or corresponding couplings, a conductor from the buttons to the electrodes and the very electrodes. This is a rather complicated transmission path for signals, as it is to be remembered that the circumstances in which e.g. an electrode belt is used are demanding. So for instance an electric connection between the transmitter electronics and the electrodes is dependent on the coupling provided by the buttons, which coupling is sensitive to getting dirty, getting damp, wear etc. Additionally, the conductor between a button and an electrode, cast inside the belt, has to resist big stresses, when the belt is bent, tightened etc.

SUMMARY OF THE INVENTION

The object of the present invention is to provide a telemetric transmitter unit not showing the drawbacks mentioned above. To provide this, the telemetric transmitter unit according to the invention is characterized in that the transmitter electronics is coupled in a fixed manner to each electrode by means of a conductive plastic layer and that the transmitter electronics, the electrodes and the conductive plastic layer are cast and/or jointed together with plastic to form an integrated transmitter unit.

In the transmitter according to the invention, buttons or other fastening means are entirely eliminated, as well as the need of separate conductors between the electrodes and the transmitter electronics. The transmitter unit thus comprises both the transmitter electronics and the electrodes packed in a section forming one whole. By means of the quality, design and treatment at jointing of the various plastic parts, a rather incomparable device has been provided with respect to prior art transmitters, as far as reliability of operation, manageability, durability and also waterproofness are concerned. For instance, an electrically conductive plastic, preferably consisting of conductive polyurethane, combines in a suitable manner two properties of plastic mostly opposite to each other, viz. its conductivity and the elasticity required. Considerable efforts have been necessary to find a suitable combination. A break in the conductive plastic layer e.g. would make the whole transmitter unusable and irreparable in a moment.

The other preferred embodiments of the invention are characterized in what is presented in the claims below.

BRIEF DESCRIPTION OF THE DRAWINGS

In the following, the invention will be explained in greater detail by way of examples referring to the drawings enclosed, in which.

DETAILED DESCRIPTION OF THE PREFERRED EMBODIMENTS

Figure 1:
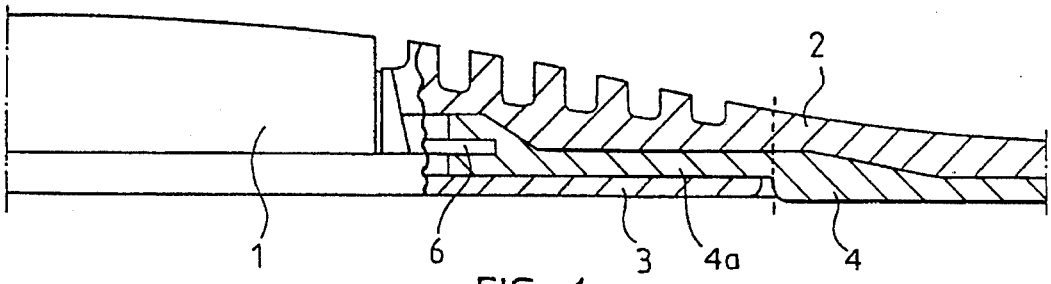
FIG. 1 is a partial cross-section of a part of a telemetric transmitter according to the invention from the side.

A telemetric transmitter of the invention, constructed according to FIG. 1, comprises a casing 1 containing transmitter electronics, plastic layers 2, 3 above and below the transmitter, an electrode 4 and a conductive plastic layer 5 connecting the electrode to a printed circuit board 6 of the transmitter electronics. The transmitter electronics 6 is coupled in a fixed manner to the electrode 4 with the conductive plastic layer, and the parts are cast or jointed together in order to unite the plastic layers 2, 3 and the casing 1 to form an integrated transmitter unit.

In use, signals detected by the electrode 4 connected to the transmitter electronics 6 are transmitted wirelessly to a separate receiver by means of a transmitter coil (cf. FIG. 4) by using a magnetic proximity field, as presented in the Finnish Patent 68734 mentioned above. That example case relates to the detection of EKG and heartbeat signals e.g. from the chest of a sportsman and to the transmission of amplified signals to a wrist receiver, by means of which the sportsman can follow the development of the pulse. There can be also other signals to be transmitted, information of blood pressure e.g., and the transmitter can be positioned on a place on the skin of any living being where detectors can detect the signals desired. The only substantial thing for telemetric data transmission is that the transmission takes place wirelessly by detecting in the receiver a pulsating or variable magnetic field generated by the transmitter.

Figure 2:
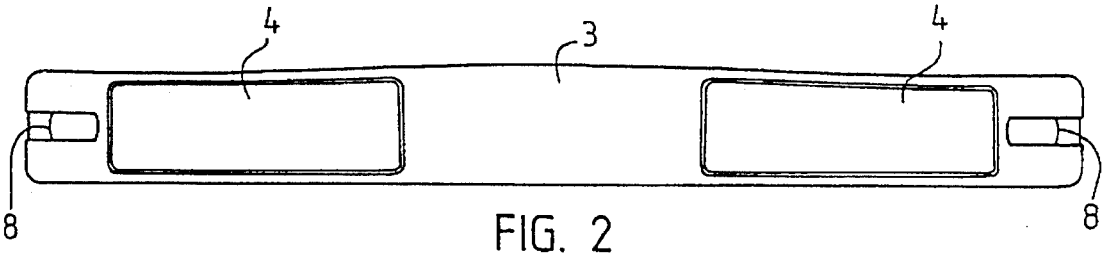
FIG. 2 shows the telemetric transmitter of the invention from below.
Figure 3:
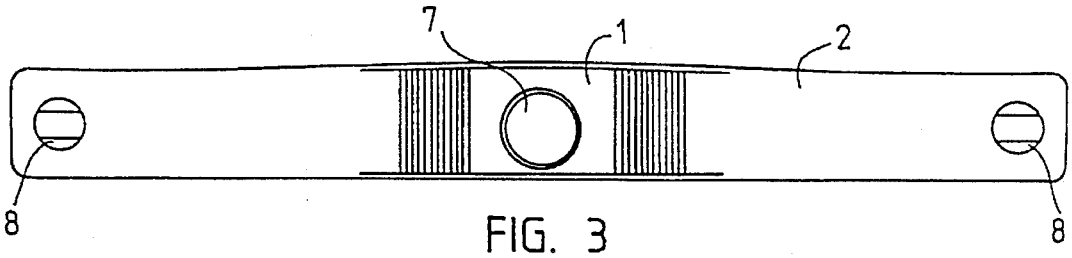
FIG. 3 shows the telemetric transmitter of the invention from above.

FIG. 2 and 3 show the structure of the transmitter as a whole. The transmitter has been formed to a band-like structure provided with means 8 at the ends thereof to be fastened to a carrying belt of the user. The casing 1 containing the transmitter electronics has been formed of a hard polyurethane resistant to wear and shock. Its upper part comprises a cover 7 of a battery casing of the transmitter. The cover can also be omitted, in which case the structure becomes even tighter (cf. FIG. 5). The plastic layers 2, 3 above and below the transmitter can preferably be formed of a relatively soft polyurethane in order to provide the necessary elasticity. The transmitter comprises two electrodes 4 positioned symmetrically on both sides of the electronics section in openings made in the plastic layer 3 below the transmitter in order to come into contact with the skin of the user. All parts 1 to 4 have been jointed together in a waterproof manner.

The conductive plastic layer connecting the transmitter electronics to the electrodes is preferably also formed of polyurethane so that the plastic qualities to be joined together have a similar structure and thus form a structure as tight as possible. A suitable grade of electrically conductive polyurethane is e.g. "Polyurethane Estane Compound T4057" manufactured by BF Goodrich Chemical.

Figure 4:
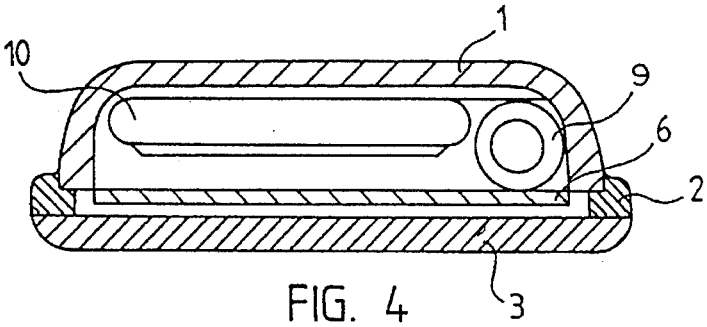
FIG. 4 is a cross-section of the telemetric transmitter of the invention.

FIG. 4 shows a cross-section of the casing 1 containing the transmitter electronics. Substantial parts are the very electronics or more correctly the printed circuit board 6 thereof, a transmitter coil 9 and a battery 10.

Figure 5:
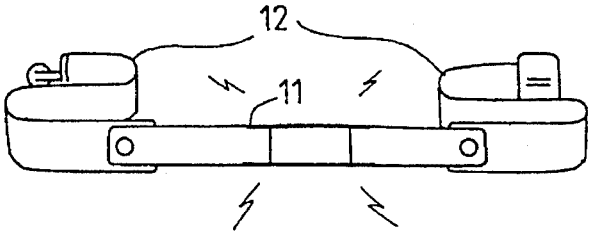
FIG. 5 shows the transmitter of the invention fastened to a carrying belt.

FIG. 5 shows the transmitter 11 of the invention when fastened to a carrying belt 12 to be tightened around the chest of the user. The transmitter in question has no cover for the battery casing. By maximizing the life time of the batteries and by minimizing the current consumption of the transmitter, it is possible to achieve such an operating time by means of one battery that it's not worth while to provide a structure with an opening for a battery exchange.

It is evident for one skilled in the art that the various embodiments of the invention are not restricted to the examples presented above, but that they can vary freely within the scope of the claims given below.

We claim:

1. A telemetric transmitter unit comprising:

(a) one or more electrodes for placement on the skin of a living being and detecting signals from the living being;

(b) a transmitter for receiving signals from the one or more electrodes and generating a magnetic field in response to the received signals so as to wirelessly transmit the signals by using a magnetic proximity field, said transmitter including transmitter electronics;

(c) an electrically conductive plastic layer fixedly coupling the one or more electrodes to the transmitter electronics; and (d) one or more plastic members joining the transmitter electronics, the electrodes and the conductive plastic layer together so as to form an integrated, waterproof transmitter unit, wherein the one or more plastic members comprises a plastic casing containing the transmitter electronics, and first and second plastic layers disposed one on the other and closing one side of the casing, one of the plastic layers being provided with one or more openings therein for holding the one or more electrodes so as to permit contact with the skin of a user during use of the unit.

2. The transmitter unit of claim 1, wherein the casing is formed of a hard polyurethane, the first and second plastic layers are formed of a soft, elastic polyurethane, and the casing and the plastic layers are joined together in a waterproof manner.

3. The transmitter unit of claims 1 or 2, wherein the conductive plastic layer is formed of a conductive polyurethane.

4. The transmitter unit of claim 3, wherein the transmitter unit is in the form of a band and is provided at each end thereof with fastener means for fastening the transmitter unit to a carrying belt of a user.

5. A telemetric transmitter unit comprising:

(a) a first elongated plastic layer having one or more openings therein;

(b) an electrode positioned in at least one of the openings for placement on the skin of a living being and detecting signals from the living being;

(c) a casing mounted on one surface of the first plastic layer;

(d) a transmitter for receiving signals from one or more of the electrodes and generating a magnetic field in response to the received signals so as to wirelessly transmit the signals by using a magnetic proximity field, said transmitter including transmitter electronics contained in the casing and including a printed circuit board with at least one end electrically connected to one of the electrodes;

(e) an electrically conductive plastic layer affixed to said one surface of the first plastic layer, with at least one end portion of the conductive plastic layer on at least one side of the casing affixed to the circuit board and another portion thereof extending to one of the openings and connected to an electrode therein; and (f) a second plastic layer affixed to the conductive plastic layer and overlaying a portion of the first plastic layer adjacent the casing, with the conductive layer being sandwiched between the first and second plastic layers at areas adjacent the casing.

6. The transmitter unit of claim 5, wherein the casing is formed of a hard polyurethane, the first and second plastic layers are formed of a soft, elastic polyurethane, the conductive layer is formed of conductive polyurethane, and the casing and the plastic layers are joined together in a waterproof manner.

7. The transmitter unit of claim 5, wherein the conductive plastic layer extends to and covers the one or more openings in the first plastic layer.

8. The transmitter unit of claim 5, wherein the first elongated plastic layer is in the form of a band and is provided at each outward end thereof with fastener means for fastening the transmitter unit to a carrying belt of a user.

9. The transmitter unit of claim 6, wherein the conductive layer and the one or more electrodes are integrated.

* * * * *